US007460002B2

(12) United States Patent
Estrov

(10) Patent No.: US 7,460,002 B2
(45) Date of Patent: Dec. 2, 2008

(54) TERMINAL SYSTEM FOR PLANAR MAGNETICS ASSEMBLY

(76) Inventor: Alexander Estrov, 5782 NW. 38th Ter., Boca Raton, FL (US) 33496

( * ) Notice: Subject to any disclaimer, the term of this patent is extended or adjusted under 35 U.S.C. 154(b) by 58 days.

(21) Appl. No.: 11/148,510

(22) Filed: Jun. 9, 2005

(65) Prior Publication Data

US 2006/0279394 A1 Dec. 14, 2006

(51) Int. Cl.
*H01F 5/00* (2006.01)

(52) U.S. Cl. ..... 336/200; 336/182

(58) Field of Classification Search ..... 336/200
See application file for complete search history.

(56) References Cited

U.S. PATENT DOCUMENTS 2,188,651 A 1/1940 Cox
2,246,167 A 6/1941 D'Entremont
2,826,747 A 3/1958 Carey
3,001,162 A * 9/1961 Riley ..... 336/61
3,076,165 A 1/1963 Weyrich
5,010,314 A 4/1991 Estrov
6,046,662 A * 4/2000 Schroter et al. ..... 336/83
6,114,939 A 9/2000 Wittenbreder
6,335,671 B1 * 1/2002 Roessler et al. ..... 336/65
6,882,260 B2 * 4/2005 Katzir et al. ..... 336/200

OTHER PUBLICATIONS

"Double L-Shaped Terminal System", Patentability Search Report; Epsilon Patent Searching, Apr. 12, 2005.

* cited by examiner

*Primary Examiner*—Elvin Enad
*Assistant Examiner*—Joselito Baisa
(74) *Attorney, Agent, or Firm*—McHale & Slavin, P.A.

(57) ABSTRACT

A planar magnetic device comprising a planar core, a first plurality of planar windings having apertures, a second plurality of planar windings having apertures, a planar core surrounding at least a portion of the first and second plurality of planar windings, a first terminal having first and second legs separated by about ninety degrees, and a second terminal having first and second legs separated by about ninety degrees, wherein the first leg of the first terminal is positioned through the apertures in the first plurality of planar windings, the first leg of the second terminal is positioned through the apertures in the second plurality of planar windings such that the second leg of the first terminal is adjacent the second leg of the second terminal.

6 Claims, 3 Drawing Sheets

TERMINAL SYSTEM FOR PLANAR MAGNETICS ASSEMBLY

STATEMENT REGARDING FEDERALLY SPONSORED RESEARCH OR DEVELOPMENT

N/A

CROSS-REFERENCE TO RELATED APPLICATION

N/A

FIELD OF THE INVENTION

This invention relates generally to planar magnetic assemblies, and more particularly, to an improved terminal system for planar magnetic assemblies.

BACKGROUND OF THE INVENTION

Planar magnetic assemblies, i.e., transformers and inductors, are used widely in high current/low voltage switching power supplies operating from 40 kHz to 1 MHz. A typical transformer is a major part of the power converter, which either steps voltage up or down depending on the application. In higher power converters either the primary winding or the secondary winding of the transformer has to carry AC current over 100 amperes RMS and sometimes up to 500 amperes RMS or more. Filter inductors, on the other hand, have to carry DC current, but the values can also be quite high. In both cases, the planar magnetic assembly has to be connected to semiconductors, which either switch, or rectify the currents. The impedance of this connection generates power losses, additional electromagnetic interference and can be difficult to reduce.

One type of prior art high power planar transformer has copper standoffs connecting the planar layers. The layers are made of flat copper leadframes, which must be connected in parallel to reduce total DC and AC resistance of the winding. Designers normally select the thickness of the leadframes in the range of 10 to 32 mils for transformers because of the skin effect. The skin effect describes a reduction of electric field density in metal conductors as a function of waveform frequency. For example, a copper conductor carrying a 250 kHz current exhibits approximately a 37% reduction in electric field density from its surface to the depth of 5.2 mils. This depth is different for different metals and characterizes a specific skin depth for a given metal at a given frequency. Because of the skin effect, planar transformers are more efficient at higher operating frequencies than their conventional magnetic wire wound counterparts. However, even flat planar conductors do not solve the problem of sufficient copper cross-sectional area for heavy current windings. In many applications paralleling just two leadframes does not yield low enough winding resistance. Accordingly three or more leadframes must be connected. This connection must also solve a problem of electrical impedance of mechanical interface. While providing a convenient screw-type connection, standoffs have three drawbacks. First, the copper standoff must be mechanically swaged and then soldered to the leadframes. Swaging may put part of the standoff above the surface of the planar leadframe thus making electrical connection between the two flat surfaces questionable. Second, in many cases transformers are custom designed to meet specific requirements. Therefore, the distance between leadframes varies widely from model to model so that it becomes impractical to design and manufacture different height standoffs for every model. Third, connecting three or more leadframes in parallel using standoffs, while possible, presents a difficult manufacturing problem.

In another prior art embodiment, L-shaped copper terminals are soldered to multiple planar leadframes. This configuration provides a more flexible connection because a single length L-shaped terminal can accommodate almost any variances in distances between leadframes. After transformer assembly, the L-shaped terminal is inserted in slots provided for this purpose in the leadframes and soldered in place providing a flat terminal with an aperture ready for a screw-type connection to semiconductors and other components. However, there are two major problems with this approach. First, a single L-shaped terminal has to provide at least the same copper cross-sectional area, as all leadframes it connects in parallel. Increasing the L-shaped terminal's thickness will not solve the problem in an optimum way due to the skin effect. Second, soldering a very thick copper L-shaped terminal to multiple leadframes becomes a difficult manufacturing task due to the heat-sink effect of massive copper on the soldering joint.

An additional problem occurs for both standoff and single L-shaped terminals. When connecting three or more leadframes in parallel, both L-shaped terminals and standoffs bring the screw-type interface point either to the top or bottom of the planar transformer. The AC current in the leadframes tends not to equalize with most of the current flowing in those leadframes which are the closest to the connecting screw. The further away from the connecting screw that a leadframe is located in the planar stack, the less current will flow in it. This phenomena will increase AC resistance and, therefore, reduce efficiency.

Accordingly, there has been a long felt need for a flexible and low impedance terminal system which is capable of delivering large currents to semiconductor switches or rectifiers, easy to install and use, cost-effective, and improves the efficiency of planar magnetics.

SUMMARY OF THE INVENTION

In accordance with the present invention, there is provided a planar magnetic device comprising a planar core, a first plurality of planar windings having apertures, a second plurality of planar windings having apertures, a planar core surrounding at least a portion of the first and second plurality of planar windings, a first terminal having first and second legs separated by about ninety degrees, and a second terminal having first and second legs separated by about ninety degrees, wherein the first leg of the first terminal is positioned through the apertures in the first plurality of planar windings, the first leg of the second terminal is positioned through the apertures in the second plurality of planar windings such that the second leg of the first terminal is adjacent the second leg of the second terminal.

The present invention also provides a method of making a planar magnetic device comprising the steps of dividing the planar windings into first and second portions, inserting a first plurality of L-shaped terminals into apertures in the first portion of planar windings, inserting a second plurality of L-shaped terminals into apertures in the second portion of planar windings, and positioning the first and second portions of planar windings in a ferrite core such that legs from the first plurality of L-shaped terminals are adjacent legs of the second plurality of L-shaped terminals.

In an alternative embodiment, the present invention provides a planar magnetic device comprising a planar core, a first plurality of planar windings having apertures, a second plurality of planar windings having apertures, a planar core surrounding at least a portion of the first and second plurality of planar windings, a T-shaped terminal having a first portion positioned through the apertures in the first plurality of planar windings and a second portion positioned through the apertures in the second plurality of planar windings.

The terminal system of the present invention provides a totally flexible paralleling of any combination of leadframes in the same way as a single L-shaped terminal, but it brings the screw-type interface point to the middle of planar transformer. In such construction, AC current in the leadframes tends to flow symmetrically from both halves of the planar stack. The currents in the leadframes do not vary as much, therefore reducing AC resistance and increasing efficiency. Compared to a single L-shaped terminal, a double terminal system provides twice the cross-sectional copper area for conduction given the same terminal thickness, thus the AC and DC resistance of the interface is reduced, and efficiency is further increased. The assembly process of the present invention is also improved over the prior art since soldering of the double terminal system to corresponding leadframes is easier. Still further, the present invention also reduces overall converter height because relevant screws, washers, and nuts are not shifted to either the top or bottom of the planar transformer, as is the case with a single L-shaped terminal.

Other advantages and applications of the present invention will be made apparent by the following detailed description of the preferred embodiment of the invention.

DETAILED DESCRIPTION OF THE PRESENT INVENTION

Figure 1:
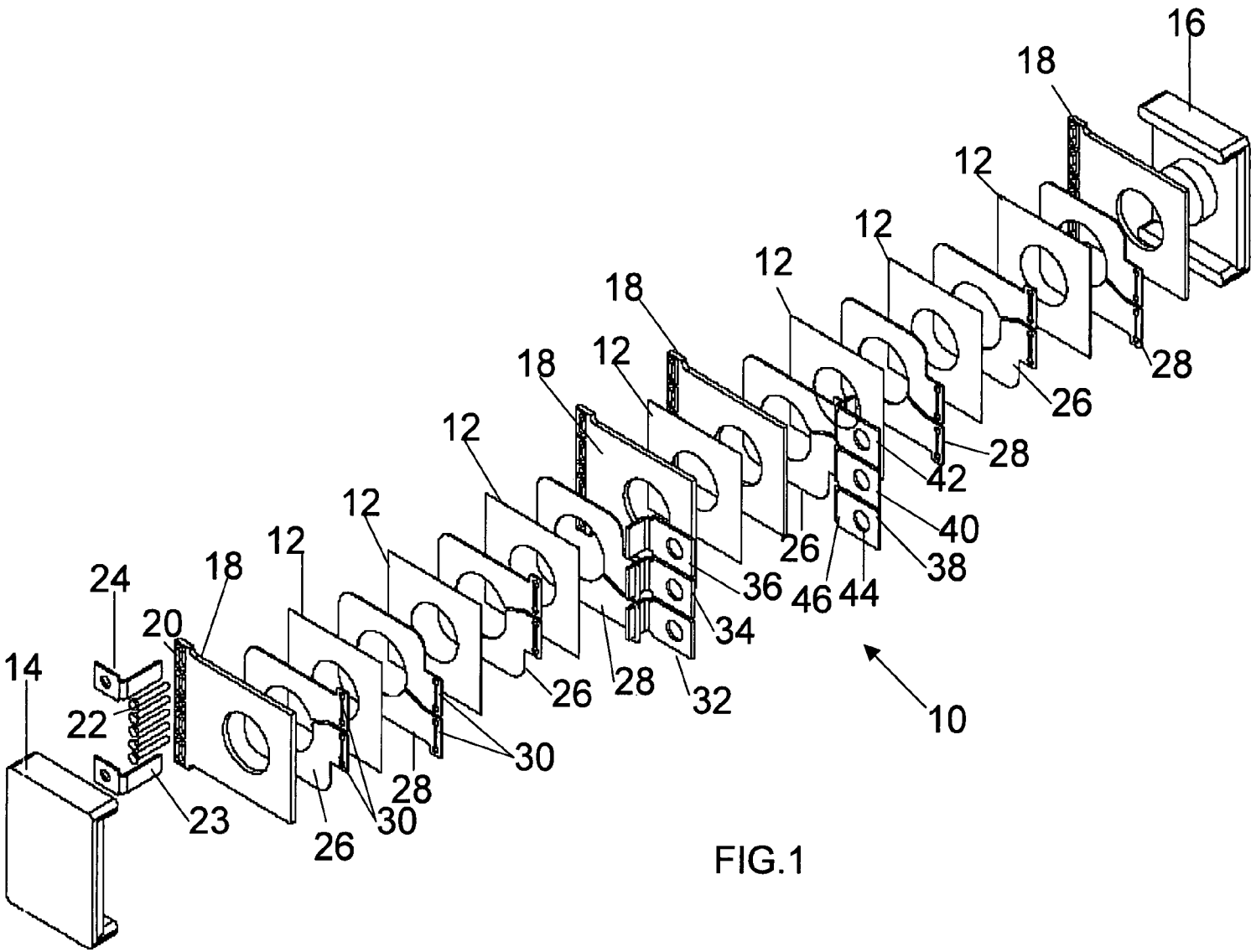
FIG. 1 is an exploded perspective view of one embodiment of a planar magnetic assembly utilizing the present invention.
Figure 2:
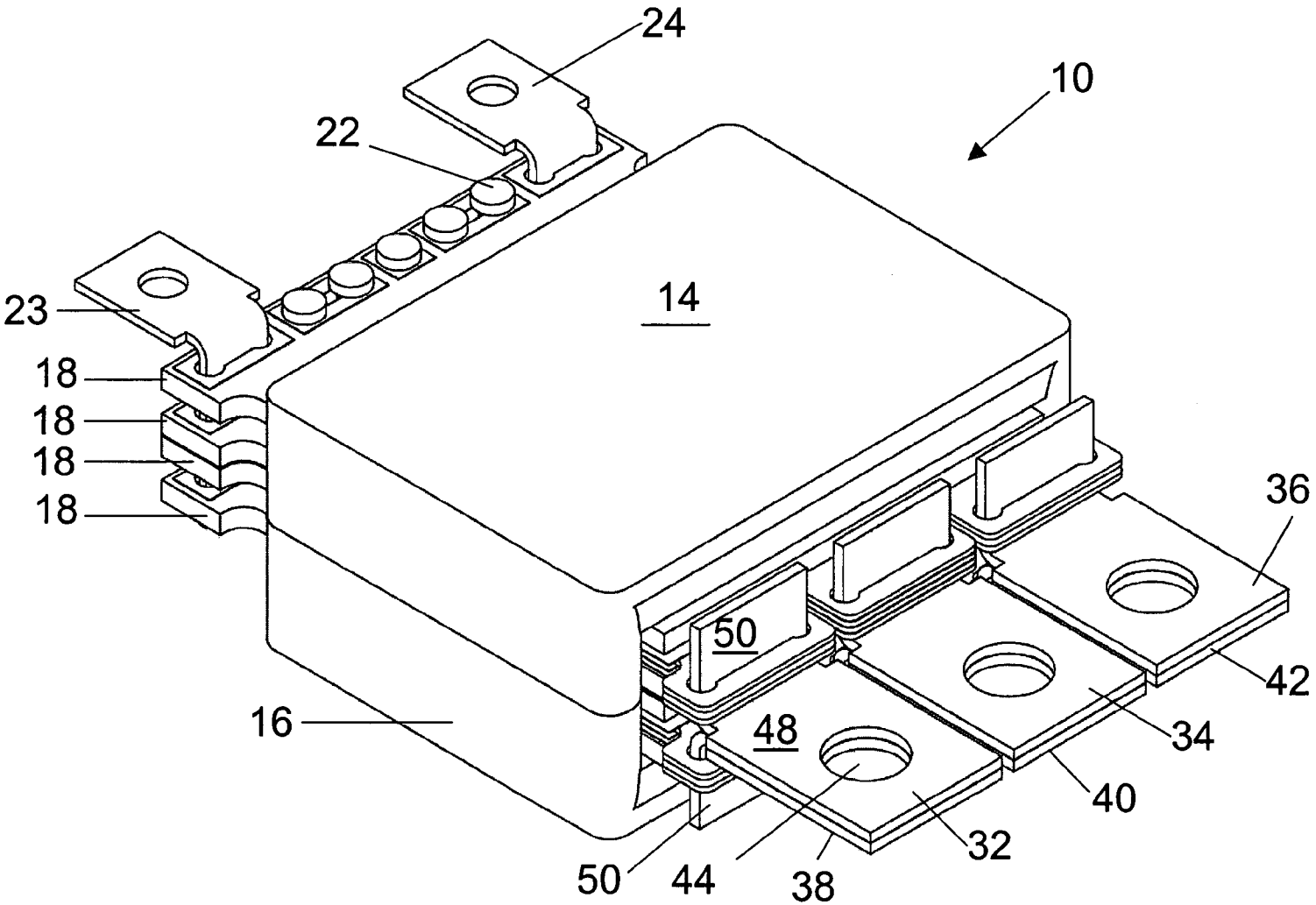
FIG. 2 is a perspective view of one embodiment of a planar magnetic assembly utilizing the present invention.

Referring to FIGS. 1 and 2, a planar transformer 10 utilizing the present invention is shown; however, it should be understood that planar transformer is merely exemplary and could have other configurations or could be a planar inductor rather than a planar transformer. Planar transformer 10 has a plurality of thin dielectric insulators 12 with a plurality of planar primary windings 18 and a plurality of planar secondary windings 26 and 28 positioned between insulators 12. Primary windings 18 have a plurality of apertures 20 through which pins 22 and L-shaped terminals 23 and 24 are positioned. L-shaped terminals 23 and 24 are positioned through each of planar primary windings 18. Planar transformer 10 has a plurality of terminals 32, 34, 36, 38, 40, and 42 that are L-shaped having two legs 48 and 50 that are approximately 90° apart with an aperture 44 through flat surface 46 on leg 48. Legs 50 of L-shaped terminals 32-42 are positioned through apertures 30 in secondary windings 26 and 28. Legs 50 of terminals 32, 34, and 36 are positioned through half of the planar secondary windings 26 and 28 and legs 50 of terminals 38, 40 and 42 are positioned through the other half of planar secondary windings 26 and 28 so that flat surfaces 46 of legs 48 are adjacent and apertures 44 of legs 48 of terminals 32 and 38, terminals 34 and 40, and terminals 36 and 42 align. Each of thin dielectric material 12, planar primary winding 18, planar secondary winding 26 and planar secondary winding 28 have an aperture, as is know in the art, to mate with ferrite core portion 14 and ferrite core portion 16. In this particular example, there are three terminals of a heavy current secondary winding with each half of the center-tapped winding consisting of a single turn; however, the same solution is applicable to any combination of turns windings, or to even non center-tap windings.

Planar transformer 10 is assembled by inserting terminals 32-42 through the respective halves of the planar secondary winding stack. Then the two planar stack halves are bonded together. Once the stack is fixed as a whole, terminals 32 and 38, 34 and 40, and 36 and 42 are fastened together respectively by a temporary fastener, such as a threaded bolt and nut, to provide a single double thick tab for every node. Then the terminals are soldered to corresponding leadframes creating a finished electromechanical solution. The temporary fastener holds the tabs together firmly against each other while the end of each terminal is soldered to the corresponding leadframe. Afterwards, the temporary fastener can be removed and replaced by another fastener at the customer's discretion.

Figure 3:
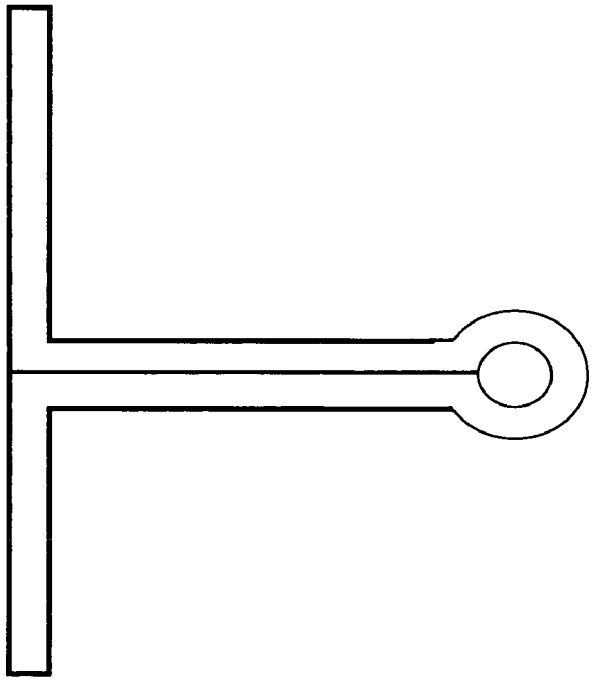
FIG. 3 is an elevational side view of an alternative embodiment of a terminal according to the present invention.
Figure 4:
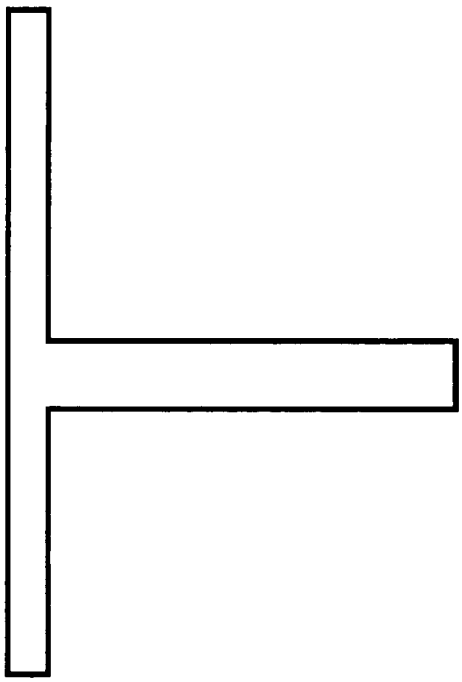
FIG. 4 is an elevational side view of an alternative embodiment of a terminal according to the present invention.

As shown in FIGS. 1 and 2, two L-shaped terminals are positioned together to form a T-shaped terminal. In an alternative embodiment a T-shaped terminal could also be used. The T-shaped terminal could be stamped or cut and then folded as shown in FIG. 3. The T-shaped terminal could also be machined or a copper T-shaped copper extrusion could be used and then cut it later into separate terminals as shown in FIG. 4.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. A planar magnetic device comprising: a planar core; a first plurality of planar windings having apertures; a second plurality of planar windings having apertures; a planar core surrounding at least a portion of said first and second plurality of planar windings; a first terminal having first and second legs separated by about ninety degrees; and a second terminal having first and second legs separated by about ninety degrees, wherein only said first leg of said first terminal is positioned through said apertures in said first plurality of planar windings, only said first leg of said second terminal is positioned through said apertures in said second plurality of planar windings, said second leg of said first terminal having a first substantially flat surface and said second leg of said second terminal having a second flat surface, said first and second substantially flat surfaces being positioned in a juxtaposed relationship to define an interface terminal having a cross-sectional thickness greater than that of either said first leg of said first terminal or said first leg of said second terminal.

2. A planar magnetic device as recited in claim 1 wherein said first leg of said first terminal has a rectangular shape and said apertures in said first plurality of planar windings are slots and said first leg of said second terminal has a rectangular shape and said apertures in said second plurality of planar wings are slots.

3. A planar magnetic device as recited in claim 2 wherein said second leg of said first terminal and said second leg of said second terminal have apertures that align.

4. A planar magnetic device as recited in claim 3 wherein said first and second terminals are L-shaped.

5. A planar magnetic device as recited in claim 4 wherein said first and second pluralities of planar windings are secondary windings.

6. A planar magnetic device as recited in claim 4 wherein said first and second pluralities of planar windings are primary windings.

* * * * *